United States Patent [19]

Wettengel et al.

[11] Patent Number: 4,768,978

[45] Date of Patent: Sep. 6, 1988

[54] CODED FUSE AND FUSE HOLDER

[75] Inventors: Lothar Wettengel, Künzelsau; Detlev Miksche; Gerhard Schrickel, both of Niedernhall, all of Fed. Rep. of Germany

[73] Assignee: R.STAHL Schaltgerate GmbH, Künzelsau, Fed. Rep. of Germany

[21] Appl. No.: 96,817

[22] Filed: Sep. 10, 1987

Related U.S. Application Data

[63] Continuation of Ser. No. 788,820, Oct. 18, 1985, abandoned.

[30] Foreign Application Priority Data

Oct. 27, 1984 [DE] Fed. Rep. of Germany ..... 3439437

[51] Int. Cl.[4] ..... H01R 13/68; H01R 13/64

[52] U.S. Cl. ..... 439/621; 337/210; 439/680

[58] Field of Search ..... 337/195, 198, 201, 209, 337/210, 213, 230, 257, 258; 439/621, 622, 677, 680, 681

[56] References Cited

U.S. PATENT DOCUMENTS

| | | | |
|---|---|---|---|
| 2,257,608 | 9/1941 | Keefe | 337/207 |
| 2,481,893 | 9/1949 | Wilcox | 337/213 |
| 2,497,470 | 2/1950 | Roukos, Jr. | 337/230 |
| 3,627,942 | 12/1971 | Bobb | 339/186 M |
| 3,815,072 | 6/1974 | DiMarco et al. | 337/209 |
| 3,891,292 | 6/1975 | Blight et al. | 339/147 R |
| 4,307,927 | 12/1981 | Mollman | 339/186 M |
| 4,329,006 | 5/1982 | Gale | 339/126 R |
| 4,481,496 | 11/1984 | Norden | 337/213 |

FOREIGN PATENT DOCUMENTS

| | | | |
|---|---|---|---|
| 134652 | 10/1949 | Australia | 337/213 |
| 107788 | 11/1927 | Austria . | |
| 015094 | 3/1980 | European Pat. Off. . | |
| 134404 | 9/1902 | Fed. Rep. of Germany . | |
| 6919101 | 10/1969 | Fed. Rep. of Germany . | |
| 2903826 | 8/1980 | Fed. Rep. of Germany . | |
| 2063804 | 7/1971 | France . | |

OTHER PUBLICATIONS

German Standard (DIN) VDE 0170/0171, = European Standard EN 50 014.

*Primary Examiner*—Gil Weidenfeld
*Assistant Examiner*—Gary F. Paumen
*Attorney, Agent, or Firm*—Frishauf, Holtz, Goodman & Woodward

[57] ABSTRACT

A fuse element with an essentially prismatic or cylindrical casing contains two electrical contacts that are accessible from the outside, that are situated on at least one exterior side of the casing and are electrically connected with a fuse arrangement inside the casing. In the casing an encoding arrangement is provided in which the electrical tripping characteristics of the fuse arrangement are encoded. To ensure a sufficient encoding variety with miniaturized design versions, even at higher manufacturers' tolerances, the encoding arrangement is formed by at least one appendage that is laterally or radially protruding from the casing in relation to the longitudinal axis of the casing and in whose configuration the tripping characteristics of the fuse arrangement are encoded.

47 Claims, 7 Drawing Sheets

3
88
9
82
81
8
15
3
86
85
81
82
8
9
4
84

79
87
61
83

CODED FUSE AND FUSE HOLDER

This application is a continuation, of application Ser. No. 788,820, filed Oct. 18, 1985, now abandoned.

The invention relates to a fuse arrangement coded according to the current-carrying capacity and/or tripping characteristics of the fuse it contains. The invention also relates to a socket configured to accept only appropriately coded fuse elements or holders.

BACKGROUND

In electrical apparatus in which safety requirements are very stringent, for example in safety barriers according to German Engineering Standard VDE 0170/0171, the required fuse has until now been inserted and encapsulated in such a way that the subsequent changing of a burned fuse is not possible, rendering the entire mechanism useless. This is done to prevent the improper repair and exchange of fuses such as the substitution of frequently burnt-out fuses by those of a higher rating.

Known glass tube heat coil fuses can be substituted in this manner without difficulty, since the dimensions of the casing are the same, regardless of rating and tripping mechanism.

To prevent the substitution of fuses with a lower rating by those with a higher rating, one measure—as far as domestic fuses are concerned—is to vary the diameter of the end face according to the rating of the fuse. In such cases the socket is designed with a ceramic ring around one of its contacts, so that only fuses with a sufficiently small end face can touch the electrical contact.

Because of necessary manufacturers' tolerances on the one hand and a certain minimum stability on the other hand, even with miniaturized fuses, only relatively few current ratings can be encoded in that fashion.

Because of the cylindrical design not only of domestic fuses but also of glass tube fuses, it is very easy to carry out unauthorized repairs of inserting solid pieces of wire into the sockets.

According to German Utility Model 84 11868 a miniature fuse is known in whose fusible insert some contact pins are connected mechanically and with electric conductivity, pointing radially outward through openings in the area where the casing sleeves are joined.

Since this miniature fuse is meant to be soldered into printed circuit boards, the contact pins are adapted to fit the holes in the boards, and assembly errors are prevented by varying the spacing of the contact pins. This means that only those miniature fuses can be inserted in the printed circuit board in which the spacing of the contact pins matches the spacing of solder on the printed circiut board.

However, on account of miniaturization, this method does not lead to a very great choice in variety, because the solder points on printed circuit boards normally have a grid spacing of 2.5 mm. Thus the spacing variation of the contact pins in miniature fuses has to follow the 2.5 mm grid.

THE INVENTION

It is an object to provide a fuse element that allows for a great number of encoding choices, even with miniaturized designs. It is an additional object to provide a socket with which unauthorized bridging of contacts meant for the fuse element is difficult.

Briefly, an encoding arrangement is provided which is designed as an appendage to a fuse housing or casing, which appendage protrudes laterally or radially in relation to the longitudinal axis of a fuse casing or housing. This provides for a large number of possible encoding choices, since the external design of the appendage can vary greatly even with miniaturization and while retaining adequate stability. The appendage can be robust enough to prevent the forced insertion of a fuse element of incurrent electric current-carrying capacity.

The appendage suited for this purpose can be attached to the casing in either rigid or movable form. The fuse casing housing retains a fuse element.

The unauthorized repair or bridging of the fuse is effectively prevented when the laterally projecting appendage carries at least one of the two contacts because then associated lateral contacts are necessary in the chamber of the fuse socket receiving the fuse arrangement. It is particularly advantageous if the contact is inserted into the appendage and—coming from the inside of the casing—protrudes from the appendage laterally or radially in terms of the longitudinal axis of the casing, so that the counter contact can be concealed inside the socket.

A very robust appendage and a further hindrance to unauthorized manipulation of the fuse arrangement in terms of encoding results when the appendage extends over the entire length of the casing and contains both contacts which are at a distance to each other in longitudinal direction of the appendage. If the number of encoding combinations exceeds that which can be achieved with one appendage, or if encoding is to be independent of the capacity and to include, for example, the tripping characteristics, the encoding arrangement may have a second appendage which—as the first—protrudes laterally or radially in relation to the longitudinal axis of the casing and subtends together with the first appendage an angle other then zero degrees, measured on a plane perpendicular to the longitudinal axis of the casing. The load-carrying capacity and/or the tripping characteristics of the fuse arrangement can be encoded in the angle, subtended by the two appendages, and/or in the configuration of the second appendage.

Should further encodings become necessary while the external dimensions of the fuse casing remain the same, recesses can be provided in the first and/or second appendage in whose axial position the configuration, depth and/or length, the electrical load-carrying capacity and/or the tripping characteristics and encoded.

Another means of maintaining the encoding or of extending the encoding variety without having to provide a separate casing for each type of fuse is to design the casing as a base structure on which a rotatably mounted carrier is attached whose integral part is at least one appendage that belongs to the encoding arrangement. In the configuration of this first appendage, the electrical tripping characteristics are encoded. Especially much space can be saved when the encoding is done through an appendage which—measured in a plane vertical to the longitudinal axis of the casing—extends over a varying circumferential region, while the radial dimensions of the appendage are constant.

When this carrier is arranged at one of the two end faces of the base structure of the casing, it can simultaneously serve as a complete closure for the opening of the fuse, when, for example, the fuse element is rotated about its longitudinal axis in order to touch the contacts in the socket.

In accordance with a feature of the invention, a universal fuse that is adapted by simple means to the current-carrying capacity can be obtained when in longitudinal direction as seen from the base structure of the casing, between the first appendage and the end face of the carrier pointing away from the base structure toward the outside, a second appendage is provided whose length in circumferential direction equals the maximum length in circumferential direction of the first appendage and which overlaps the first appendage. The result is that regardless of the encoded electrical value the opening of the socket is always smoothly closed, and the rim of the opening does not have to be adapted to the individual electrical values. The encoding of the socket can be obtained by means of an encoding plate, preferably of metal, provided below the outer edge of the insertion opening.

While using the encoding appendage at the carrier, the base structure of the casing can also be provided with an appendage that extends in its longitudinal direction and can be utilized for encoding as well, although this is not necessary. Through this appendage run the contacts that protrude laterally or radially in terms of the longitudinal axis of the casing, and the carrier which has a level end face forms an integral part with a third appendage whose projection in the direction of the casing is equal to or greater than the projection of the appendage at the base structure of the casing, including the overlapping contacts, while all appendages of the carrier are non-contacting.

The fuse element can be inserted particularly easily when the carrier is mounted with limited rotatability; it is an advantage when the carrier is inserted in the base structure of the casing in at least one position in which its appendages are aligned flush with the appendages or contacts at the base structure of the casing.

Another solution is to mount the appendage movably in the casing so that it can be moved from an off position behind the outer rim of the casing to an on position (protruding beyond the outer rim) and back again. Thus the fuse element can only be inserted when the appendage is in off position, while it cannot be removed when the appendage is in on position. It is advantageous when the movable appendage is coupled with one of the contacts in such a way that the contact protrudes beyond the rim of the casing only when the movable appendage is in on position in the sense of making contact with the socket, while the contact is retracted in off position.

An especially simple mechanical solution is achieved when the rotational axis of the movable appendage and thus of the contact coupled therewith runs parallel to the longitudinal axis of the casing, while the appendage is designed with a tool holding arrangement for an operating tool. By means of the tool holding arrangement, the unauthorized manipulation of the fuse can be limited even further.

To allow the covering and closing of the openings in the socket that are necessary for the appendages, an end face of the casing can be provided with a radially projecting circular rim that covers the appendage(s), a particular advantage when the fuse element is rotated for the purpose of providing contact in the socket.

The fuse element can be manufactured particularly cost-effectively when the fuse arrangement is designed with a commercially available glass tube heat coil fuse with metallic end caps fastened in a cavity of the casing. Simple contact of the heat coil fuse is achieved by means of contact vanes that fit on the metallic end caps, project outside through the associated appendage(s) and form the contacts of the fuse element.

To avoid having to provide different casing configurations for encoding, a spacer can be placed between the contact vanes, especially in the embodiment using a glass tube heat coil fuse, reaching into the appendage between the contacts and containing a recess aligned flush with the recess in the appendage in whose configuration the electrical characteristics of the fuse element are encoded.

In the socket particularly suited for this purpose, in which the opening for inserting the fuse element forms at least a part of the encoding arrangement, at least one of the contacts is situated laterally to the inserted fuse element, and the position and configuration of the contacts is adapted to the operating position of the associated contact of the fuse element. Alternatively both contacts of the socket can be arranged laterally which—as explained above—makes it considerably more difficult to establish an unauthorized bridge between the contacts. A further improvement can be achieved when the chamber is designed in such a way that the inserted fuse element is at least partially rotatable in the chamber because in that case the contacts are behind the inner edge of the opening and are practically inaccessible from the outside.

This design of the chamber is also desirable if one of the appendages of the fuse element has a recess and the encoding arrangement has a projection that juts into the chamber and whose configuration is adapted to the configuration of the cooperating recess of the fuse element in such a way that it is only possible to set the contacts if there is sufficient matching between the configuration of the recess and that of the projection, and that it is blocked otherwise.

In case of a fuse element provided with a movable appendage, the chamber has below the opening a lateral recess that is open toward the inside of the chamber and is situated in the path of motion of the movable appendage and whose configuration is adapted to the configuration of the movable appendage in such a way that it is only possible to adjust the appendage if there is sufficient matching between the movable appendage and the recess.

The socket can be designed to be aligned flush with the outside end face of the fuse element while increasing the number of encodings if the opening is surrounded by a rim arranged outside the chamber, adapted to the outer contour of that end face of the fuse element.

If the socket with its associated contacts is designed to be an integral part of the casing of the electrical apparatus, it is advantageous when the opening adapted to the outer contour of the fuse element is arranged in an encoding plate that can be inserted into the socket, because in that case it is unnecessary to provide a separate casing for each type of fuse. The same applies to the projection that juts into the chamber and can also be designed as an exchangeable part.

The matter becomes particularly simple if the insertion opening contains between its outer edge and the chamber the insertable encoding plate which has a recess that is open at least in the direction of the longitudinal axis of the socket and extends over a circumferential area in accordance with the encoding and that is aligned with a recess that is provided in the outer edge of the insertion opening and whose length in circumferential direction equals the maximum length of the recess in the encoding plate, in such a way that regardless of the encoding, each inserted fuse is aligned flush with the socket.

Such a socket can be a single constituent or at least in part a single constituent of an electrical component of a safety device or safety barrier according to German Engineering Standard 0170/0171, Part 7.

Figure 1:
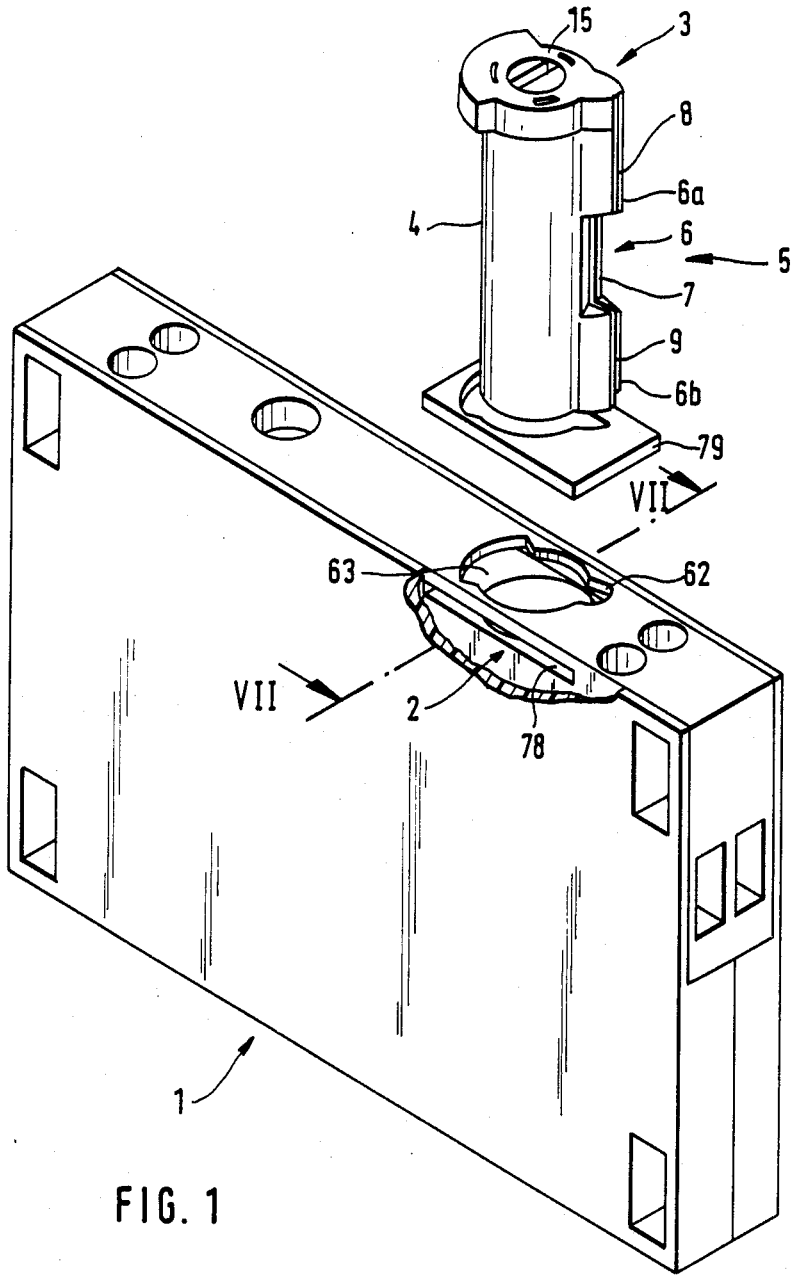
FIG. 1 shows an exploded view of a fuse element according to the invention and an electrical apparatus in which a socket for the fuse element is integrated, seen in perspective.
Figure 2:
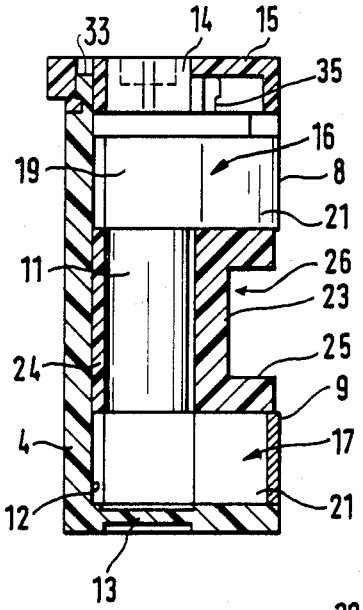
FIG. 2 shows the fuse element according to FIG. 1, seen in longitudinal section.

DETAILED DESCRIPTION:

FIG. 1 shows an electrical apparatus 1 in the form of a safety device or safety barrier in whose casing a socket 2 for a fuse arrangement 3 is integrated. The fuse arrangement 3 shown in detail in FIGS. 2–6 has an essentially cylindrical casing or housing 4 in which an encoding arrangement 5 is provided that is designed as appendage 6 that extends over the entire axial length of casing 4 and is separated into sections 6*a* and 6*b* by a recess 7 provided in approximately the middle of the appendage. Both parts, the casing 4 and the single-constituent appendage 6 connected thereto consist of an elastically insulating plastic material.

The appendage 6, which protrudes laterally from casing 4, has, as the drawings show, a roughly triangular cross-section and carries on its apex that points away from casing 4 two electrical contacts 8 and 9 which are connected to a fuse 11 provided inside the casing 4 in the form of a commercially available glass tube heat coil fuse measuring 5 mm×20 mm. Both contacts 8 and 9, one of which fits into section 6*a*, the other of which fits into section 6*b*, protrude slightly beyond the exterior contour of appendage 6; contacts 8 and 9 also run parallel to the longitudinal axis of the cylindrical casing 4.

Inside the cylindrical casing 4 is a smooth-walled drill hole 12 coaxial to the casing 4 which at one end face of casing 4 (in FIG. 2 at the lower end) has a one-piece bottom 13 connected to casing 4, while in its upper end face and casing closure 14 is inserted that is held in place by means of a cap 15 (FIG. 4) that snaps onto casing 4. Inserted into the cylindrical drill hole 12 is the glass tube heat coil fuse 11 onto whose metallic end cap are slid the contact vanes 16 and 17, whose configuration is shown in detail in FIG. 6.

Accordingly each contact vane 16, 17 consists of a cylindrical, sleeve-shaped section 19 which is elastically expandable due to longitudinal slotting and which has a radially protruding appendage 21 situated diagonally opposite a slot 22. The end of appendage 21 that points away from the sleeve-shaped section 19 forms contact 8 or 9 protruding from appendage 6. Together with the sleeve-shaped section 19, the contact vanes 16, 17 fit onto the associated metal cap of heat coil fuse 11; the sleeve-shaped section 19 clasps around the associated metal cap in bell fashion and fits tightly on the associated metal cap due to its own elasticity. The radially protruding appendages 21 run parallel to the mantle line of the sleeve-shaped section 19 or parrallel to the longitudinal axis of the heat coil fuse.

Figure 3:
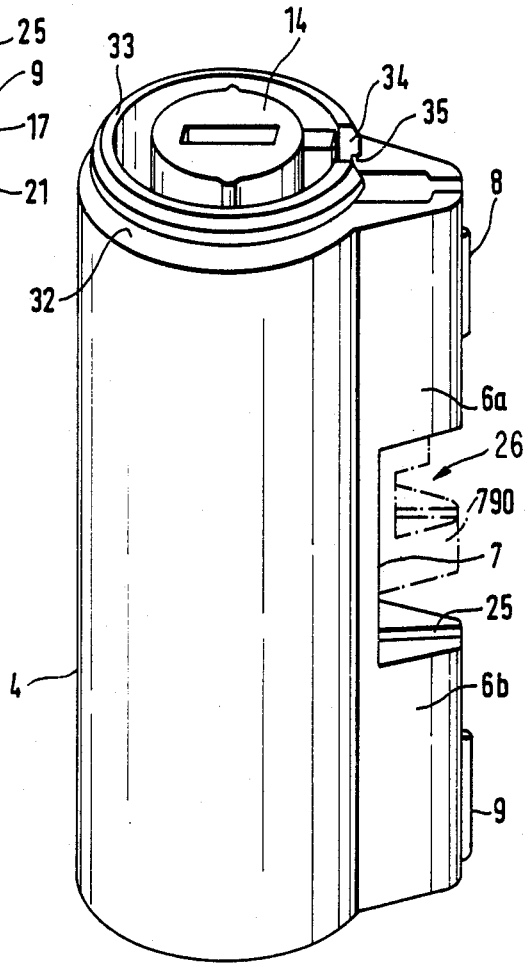
FIG. 3 shows the fuse element according to FIG. 1, with the cap removed, seen in perspective.
Figure 4:
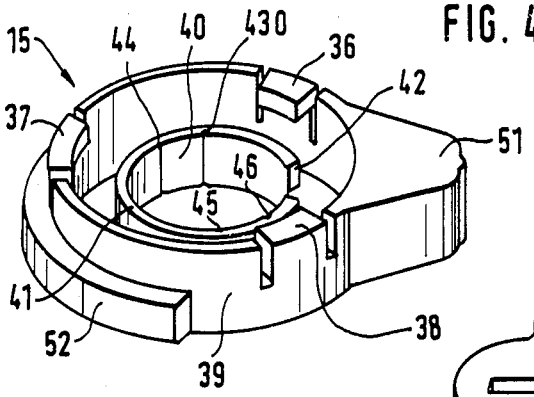
FIG. 4 shows the cap of the fuse element according to FIG. 1, seen in perspective from below.
Figure 5:
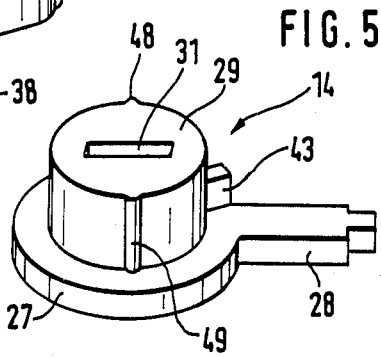
FIG. 5 shows a casing closure for the fuse element according to FIG. 1, seen in perspective.
Figure 6:
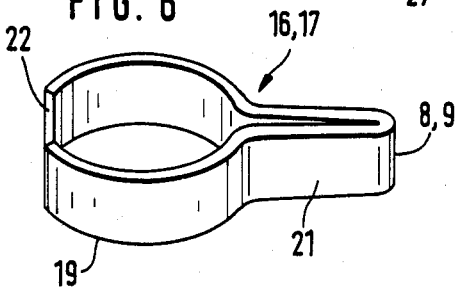
FIG. 6 shows one of the contact vanes of the fuse element according to FIG. 1, seen in perspective.

The contact vanes 16, 17 protrude outwardly with their appendages 21 through appendage 6 or its sections 6*a* and 6*b*, and for this, as FIG. 3 shows particularly clearly, appendage 6 is designed with a longitudinal slot that extends to bottom 13 and whose width corresponds to the thickness of the appendages 21.

These contact vanes 8, 9 whose height corresponds to that of the cap of heat coil fuse 11, can, for example, be bent into the appropriate shape from strips of sheet metal.

A spacer or filler 23 of plastic is positioned between contact vanes 16, 17, adjacent heat fuse 11; this spacer has the same cross sectional shape as the contact vanes 16, 17, in a section perpendicular to the longitudinal axis of fuse 11.

Spacer 23 (not visible in FIG. 3) also has a longitudinally slotted sleeve-shape section 24 and radially protruding appendages 25. The appendages 25 of the spacer 23 jut into the section of the slot in appendage 6, which is not filled by the appendages 21 of contact vanes 16 and 17. The spacer 23 has a recessed portion between the appendages 25 to define a recess 26 therebetween. This recess 26 has such a dimension that the remaining portion of the spacer 23 matches the outer dimension of the appendage 6 of the casing or housing 4. The recess 7 of appendage 6 and the recess 26 of spacer 23 are so dimensioned that the externally visible parts of spacer 23 will match with the appendage 6 of the encoding arrangement 5.

The casing closure 14 provided above fuse 11 serves the purpose of bracing the essentially cylindrical fuse 11 (that otherwise fits loosely into casing 4) with as little play as possible in axial direction.

The casing closure 14 therefore has a circular disk 27 (FIG. 5) that is inserted without play into the cylindrical drill hole 12, so that the heat coil fuse 11 with its level end faces is secured between the underside of disk 27 and the upper side of bottom 13. An appendage 28 forms an integral part radially with disk 27 and extends into that part of the slot in appendage 6 that remains free above contact vane 16 and is aligned flush with appendage 6a. A coaxial extension 29 forming an integral part with the outer end face of disk 27 forms a stopping and locking arrangement for cap 15 and also contains in its outer level end face a slot 31 with which fuse element 3 can be rotated in socket 2.

For the rotatable mounting of cap 15, the end face 32 (FIG. 3) of casing 4 that is facing away from bottom 13 has as an integral part a ring-shaped, undercut bead 33 which contains a slot 34 that is flush with the slot in appendage 6 and which allows appendage 28 of casing 14 to penetrate. Immediately adjacent to end face 32, a channel 35, running in circumferential direction, with parallel sides, forms an integral part of the ring-shaped bead 33, and into this channel engages the three claws 36, 37, 38 that belong to cap 15 shown in FIG. 4, seen from below.

Accordingly cap 15 has a cylindrical rim 39 jutting downward whose lower edge forms an integral part with the three claws 36, 37, 38. To increase elasticity, rim 39 is slotted in the immediate vicinity of claws 36–38 in the direction parallel to the mantle line, so that when rim section 39 carrying notches 36–38 can yield radially toward the outside.

The outer diameter of cap 15 corresponds to the outer diameter of casing 4, resulting in a smooth transition, while the height of the cap corresponds to the height of extension 29 that fits into a coaxial opening of cap 15 and is aligned flush with the top side of cap 15. The opening 40 within cap 15 is surrounded (FIGS. 4, 7) by a cylindrical extension 41 that has the same internal diameter and has a recess stop at number 42. This recess stop 42 acts together with a stop 43 (FIG. 5) that forms an integral part of disk 27 and limits the possible rotation of cap 15 on casing 4. Four channels 430, 44, 45 and 46 that form an integral part of the inner circumferential surface of the cylindrical extension 41 and run in longitudinal direction, serve as a locking device that acts together with the associated projections 48 and 49 in the outer circumferential surface of the cylindrical extension 29, and this results in cap 15 being held in locked position whenever recess 42 abuts at stop 43.

An integral part of the outer circumferential surface of the cylindrical rim 39 is lug 51 whose cross-section corresponds to that of projection 6; the position of lug 51 is such that when cap 15 is turned into one of its end positions, the lug is flush with appendage 6.

To increase the number of possible combinations in which the electrical characteristics of heat coil fuse 11, namely current-carrying capacity and tripping characteristics, can be encoded, cap 15 serves as a rotatable carrier for another appendage 52 (FIGS. 4, 7, 10) belonging to encoding arrangement 5. Appendage 52 forms a one-piece integral part of rim 39, and its height is less than that of rim 39. It extends in circumferential direction, and it is possible to design the encoding by varying the position of appendage 52 in relation to lug 51 and/or by changing the angle at circumference of appendage 52.

Fuse element 3 is assembled in such a way that first contact vane 16, then spacer 23, and finally contact vane 17 are pushed onto glass tube heat coil fuse 11. Spacer 23 fits essentially in the section of the glass part between the metal caps. The glass tube heat coil fuse 11 thus prepared is inserted into casing 4 together with appendage 21 or 25 that are aligned flush with each other, and then casing closure 14 is inserted. The result is the arrangement shown in FIG. 3. Following that, cap 15 is pulled over ring bead 33 until the three claws 36, 37, 38 lock in groove 35. Thus fuse element 3 is permanently sealed, and the only electrical connection with glass tube heat coil fuse 11 is via contacts 8 and 9 which jut radially from appendage 6 on both sides of recess 7.

In this embodiment there is a smooth transition between the cylindrical rim 39 and the cylindrical circumferential surface of casing 4, and the same applies in the associated position to lug 51 and appendage 6 that is situated under it. Only rim appendage 52 projects beyond the outer circumferential surface of casing 4.

Figure 7:
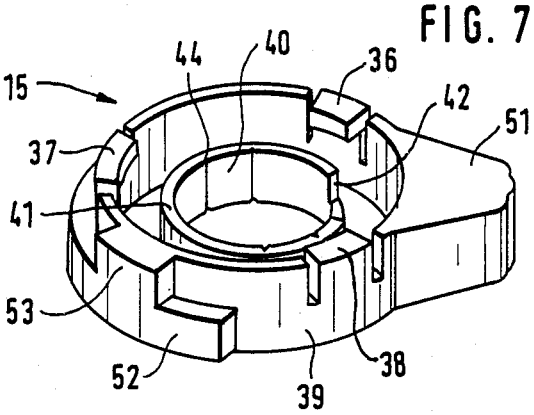
FIG. 7 shows another example of the cap of the fuse element according to FIG. 1, seen as in FIG. 4.

FIG. 7 shows an alternative embodiment of cap 15 in which the cylindrical rim 39 forms one piece not only with lug 51 and appendage 52, but also with the additional appendage 53. Appendage 52, whose radial dimension in relation to the longitudinal axis of casing 4 equals the radial dimension of appendage 52, is on the side of appendage 52, away from the face of the cap, while appendage 52 is dimensioned in such a way that it is independent of the electrical values of fuse element 11, i.e. its extension in circumferential direction of the rim is constant. Encoding is provided in the additional appendage 53 whose extension along the circumference of rim 39 depends on the electrical parameters of fuse element 11 inside casing 4. In this manner the outwardly visible face of cap 15 that points downward in FIG. 7 has a configuration that is independent of the encoding. This has the advantage that the associated encoding arrangement in the socket can be made exchangeable, as explained below.

Figure 8:
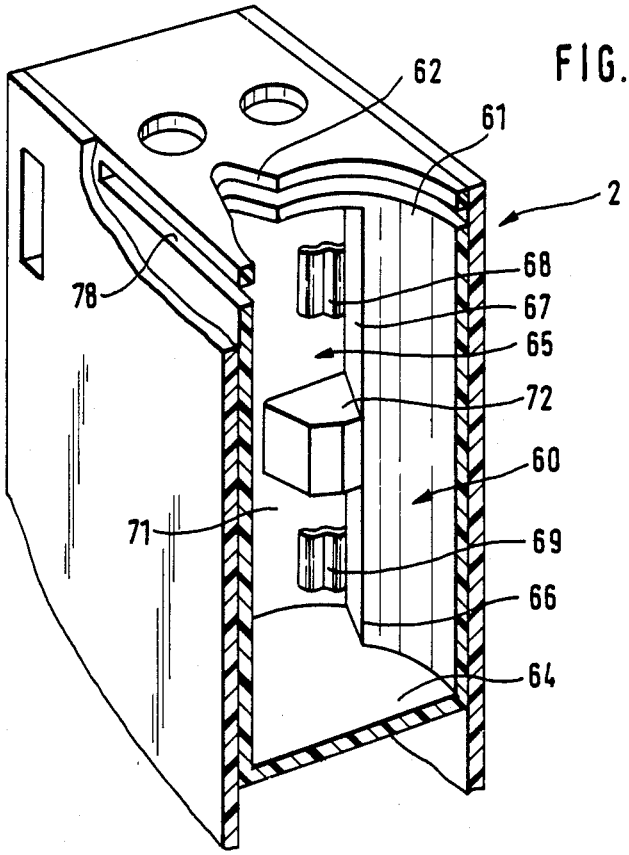
FIG. 8 shows the electrical apparatus according to FIG. 1, cut away along line VII—VII, showing detail of the chamber of the socket for the fuse element according to FIG. 1.

FIG. 8 shows a longitudinal section of socket 2 adapted to fuse element 3. The socket contains chamber 60 which like the outer circumferential surface of the cylindrical casing 4 is also cylindrical and which is accessible to fuse element 3 that can be inserted through insertion opening 61. Insertion opening 61 forms part of the encoding arrangement that belongs to socket 2 and is complementary to the encoding arrangement of fuse element 3. For this purpose the surface of insertion opening 61 equals the projection of fuse element 3, as described above, namely parallel to its longitudinal axis, i.e. the insertion opening consists of a circular opening corresponding to the diameter of the cylindrical part of casing 4 that is extended according to the contours of appendage 6 and 52, as shown in FIGS. 1 and 7. Thus the sector-shaped recess 63 (FIG. 10) serves the purpose of receiving appendage 52, while recess 62 which is adapted to a contour of appendage 6 and has a roughly triangular cross-section receives appendage 6 or lug 51.

Chamber 60 adjacent to insertion opening 61 is cylindrical with a diameter that corresponds to that of casing 4 of fuse element 3. At its side opposite insertion opening 61 it has a level bottom 64, while the distance between the upper edge of insertion opening 61 and the upper side of bottom 64 is the same as the length of fuse element 3 from its bottom 13 to the upper side of cap 15.

Below recess 62, socket 2 contains another subsidiary chamber or recess 65 that runs parallel to chamber 60 and that is connected with chamber 60 through a joint rectangular opening 66 in the wall of chamber 60. Subsidiary chamber 65 receives appendage 6 and is dimensioned in such a way that fuse element 3 can be actuated to perform a limited rotational movement about its longitudinal axis inside socket 2. Subsidiary chamber 65 therefore has a depth which—in relation to the longitudinal axis of chamber 60—corresponds at least to the radial distance between contacts 9 and 8 and the longitudinal axis of fuse element 3, and it extends in circumferential direction in relation to chamber 60, corresponding to the intended angle of rotation. To facilitate the removal of fuse element 3 from socket 2, the side wall (left in FIG. 8, not visible) of subsidiary chamber 65 runs as a direct extension of the associated side surface of recess 62, so that fuse element 3 does not have to be turned much regardless of the effectiveness of stop 43 or recess stop 42.

Opposite the above mentioned side wall of subsidiary chamber 65 is a side wall 67 from which project two elastically designed electrical contacts 68 and 69 positioned in front of rear wall 71 of subsidiary chamber 65 and extending in circumferential direction. The distance between contacts 68 and 69 corresponds to the distance between electrical contacts 8 and 9 in fuse element 3. Also protruding from side wall 67 between contacts 68 and 69 is a stop 72 that juts into subsidiary chamber 65, as shown in detail and in perspective in FIG. 9. The roughly block-shaped stop 72 has a cross-sectional surface parallel to the longitudinal axis of chamber 60 and adapted to recess 26 in appendage 6. It contains an essentially level stop surface 73 which meets an arc-shaped surface 74. Arc-shaped surface 74 extends approximately as an extension of the cylindrical side wall of chamber 60 and has a radius of curvature that is slightly greater than that of the said side wall.

To allow stop 72 to be held in socket 2, it forms an integral part with a forked bracket 75 that has undercuts 76 and that fits into an associated pocket, of socket 2, which is behind rear wall 71 and is not visible in the drawing.

The relative arrangement between recess 62, electrical contacts 68, 69 and the recess surface 73 of stop 72 is designed so that contacts 68. 69 recede slightly toward side wall 67, related to a plane containing stop surface 73, while on the other hand the above mentioned plane recedes slightly in relation to the adjacent side surface of recess 62.

Interaction between the described socket 2 and fuse element 3 is as follows:

Socket 2 can receive any fuse element 3 in which the diameter of casing 4 is smaller than the diameter of insertion opening 61 and in which the cross-sectional surface of appendage 6 is smaller than the projection of recess 62. When these conditions are met, fuse element 3 can be inserted at least up to the underside of appendage 52 (FIG. 4) at cap 15, if this appendage 52 does not fit into recess 63. Supposing that this condition is not met, a part of appendage 6 is still in recess 62; this part's height, measured in longitudinal direction of chamber 60, is the same as the height of lug 51 measured in the same direction. Recess 62, in conjunction with appendage 6, thus prevents casing 4 from being turned in relation to cap 15 which also penetrates somewhat into insertion opening 61 when it has the configuration shown in FIG. 4. Thus no contact is possible because the electrical contacts 68 and 69 are arranged in a recessed position in relation to recess 62.

The fuse element can only be inserted fully into socket 2, provided that the length is appropriate, when appendage 6 fits through recess 62 and appendage 52 fits into recess 63 (FIG. 10), which means that the cylindrical part of the casing 4 is in chamber 60 and appendage 6 in subsidiary chamber 65.

If recess 26 in appendage 6 is larger than the cross-sectional surface of stop 72, casing 4 with appendage 6 can be rotated about its longitudinal axis in chamber 60, i.e. with a screwdriver inserted into the tool slot 31. Toward the end of this rotation, whose angle is limited either by stop 43 in connection with recess stop 42 or by side wall 67, the contacts 8 and 9 of fuse element 3 connect with contacts 68 and 69 of socket 2 and provide the required electrical contact. To prevent fuse element 3 from rotating in socket 2 by itself, the electrical contacts 68 and 69 can be corrugated so that they form an elastic, detachable locking connection with electrical contacts 8 and 9, holding the fuse element 3 in on position.

If, on the other hand, a fuse element 3 is inserted which fits completely through the insertion opening 61 and its recesses 62 and 63, but whose appendage 6 has an insufficiently large radial extension, fuse element 3 can be rotated in socket 2, but no contact is achieved because contacts 8 and 9 do not reach as far as contacts 68 and 69 in the socket.

No contact is achieved either when recess 26 is smaller than the cross-sectional surface of stop 72 because, upon the attempt to rotate fuse element 3 in socket 2, the associated lateral surface of sections 6*a* and 6*b* of appendage 6 strikes stop surface 73 of stop 72 before contacts 8 and 9 can touch contacts 68 and 69.

Even the fuse element 3 described thus far offers in conjunction with socket 2 a very large number of encoding possibilities for the electrical parameters of the fuse arrangement, such as current-carrying capacity and tripping characteristics. By choosing the right dimensions for the diameter of insertion opening 61, the dimensions of recesses 62 and 63, and their relative position to each other, as well as the dimensions of the appendages 6 and 52, one can prevent the use of fuse elements 3 whose current-carrying capacity is greater than the maximum limit for the electrical apparatus in question. Recess 26 in conjunction with stop 72 (FIG. 8) considerably increases encoding versatility. As indicated by the projection shown by dotted lines 790 in FIG. 3, recess 26 does not have to have a simple rectangular cross-section but can be of a more or less complicated shape with several radial recessed portions to which stop 72 is adapted, to prevent fuse element 3 with an inappropriately contoured recess 26 from being turned into operational position.

With its cap 15, fuse element 3 inserted into socket 2 smoothly and flushly closes insertion opening 61 and its recesses 62 and 63. Fuse element 3 cannot be removed in rotated position in which contacts 8 and 9 are touching contacts 68 and 69, because then the upper edge of appendage 6 is situated in a region of subsidiary chamber 65 that is adjacent to recess 62 and closed by the upper side of apparatus 1. Only when casing 4 of fuse element 3 is turned back into a position in which appendage 6 is flush with lug 51 of cap 15, can fuse element 3 be removed from socket 2.

To increase stability in the region of insertion opening 61, it is possible to provide below the upper side of electrical apparatus 1, i.e. between the outer edge of insertion opening 61 and chamber 60, a slot 78 (FIGS. 8, 10) that runs laterally to chamber 60 and into which a plate 79 can be inserted that is adapted to the contour of insertion opening 61 and that is rectangular on the outside.

Figure 10:
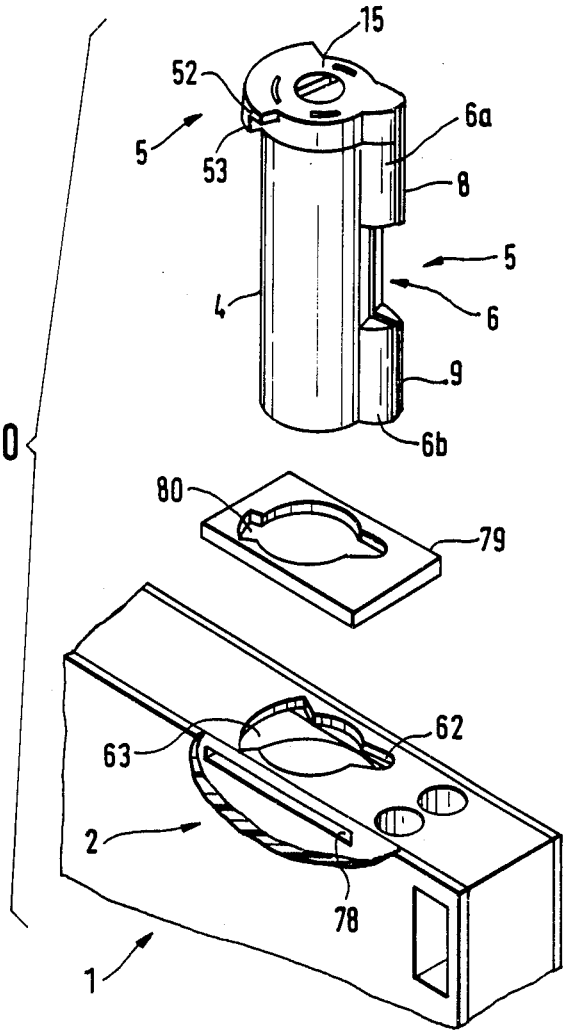
FIG. 10 shows an electrical apparatus with a socket for a cap of the fuse element according to FIG. 8, seen as in FIG. 1.

Preferably, however, plate 79 which is made of metal or plastic, serves as the part of the encoding arrangement of socket 2 that interacts with appendage 53 (FIGS. 7, 10). As FIG. 10 shows, plate 79 therefore contains a recess 80 which is open in the direction of the longitudinal axis of chamber 60 and whose shape is adapted to appendage 53, with the electrical parameters of fuse element 11 being encoded in both. Recess 63 of insertion opening 61, on the other hand, is adapted to the shape of appendage 52 and—like appendage 52—does not necessarily contain encoded information. In this manner it is possible to encode socket 2 or the casing of apparatus 1 for different fuses by means of simply exchanging plate 79 which, as shown in the FIG., is a simple molded or punched part; the molding tool for the casing of electrical apparatus 1 is not dependent on the encoding.

In this embodiment, too, in which, of course, the axial dimensions of recesses 60 and 63 are adapted to the axial dimensions of appendages 52 and 53, cap 15 is smoothly and flushly aligned with the rim of socket 2 or the casing of the apparatus.

Figure 9:
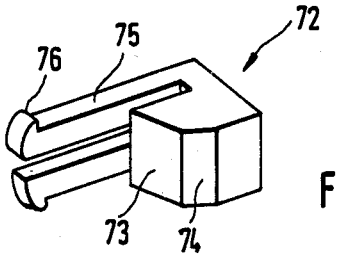
FIG. 9 shows the projection that juts into the chamber according to FIG. 8, seen in perspective.
Figures 11, 12:
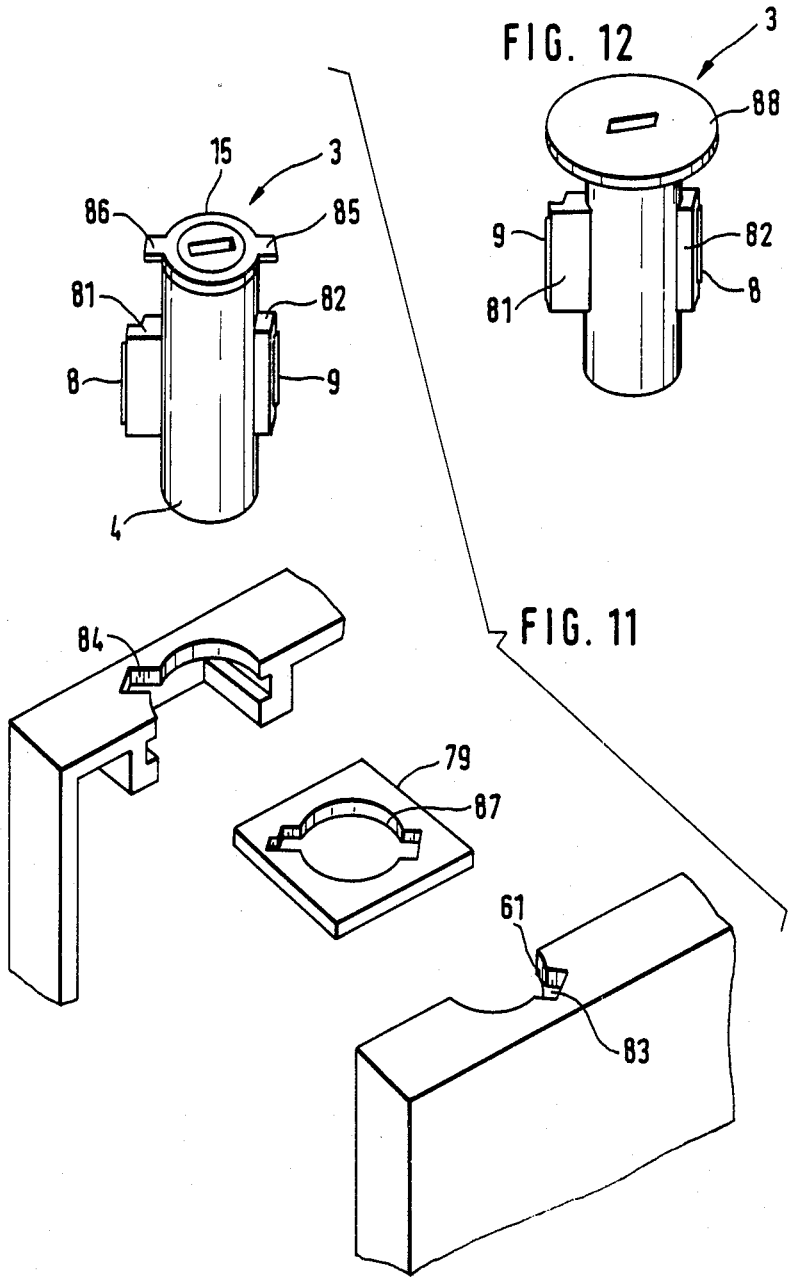
FIG. 11 shows a fuse element according to the invention with two appendages on opposite sides of the casing, and a cut-out of the associated socket, each seen in perspective.
FIG. 12 shows a fuse element similar to that shown in FIG. 11, with a rim on the end face.

Another embodiment of the type of encoding is shown in FIG. 11, where fuse element 3 (in which identical parts are again numbered the same, as explained above) carries not only one appendage protruding from the circumferential surface of casing 4, but two appendages 81 and 82 lying diametrically opposite in relation to the longtitudinal axis of casing 4, and at the same height in relation to casing 4. Each appendage 81 and 82 contains one of the electrical contacts 8 and 9 which are electrically connected to the glass tube heat coil fuse housed inside the casing 4, as described above. The internal design of fuse element 3 according to FIG. 9 is largely the same as that shown in FIG. 2 with the exception that spacer 23 can be eliminated.

In the embodiment according to FIG. 11 the tripping characteristics, as above, can be encoded in the dimensions and/or the projection surface of appendages 81 and 82. It is also possible to vary the angle subtended by appendages 81 and 82 in order to extend the encoding possibilities.

As above, it goes without saying that the insertion opening for socket 2 is adapted to the projection surface of fuse element 3, as shown in FIG. 11 as well. Accordingly insertion opening 61 is designed with two recesses 83, 84 corresponding to diametrically opposed appendages 81 and 82 which are sufficiently large and are sealed, after fuse element 3 is inserted, by appendages 85 and 86 and by cap 15 which rotatably fits onto casing 4. But the encoding can also be achieved by means of metal plate 79 which is provided below insertion opening 61 and whose opening 87 exactly matches the contour of appendages 81 and 82, while recesses 83 and 84 in insertion opening 61 are of such shape and size that any fuse elements 3 in a predetermined range of tripping values fit through them. In this way it is enough to have only metal plate 79 available for encoding, while for all other applications the same casing can be used with the same insertion opening 61.

In this embodiment, too, contact is made when, after insertion, the fuse element 3 is turned in the socket over a predetermined angle until contacts 8 and 9 touch the contacts in the socket whose positions, of course, are adapted to contacts 8 and 9.

As indicated in FIG. 11, appendages 81 and 82 can have a rectangular or stepped cross-section. But other cross-sections are possible as well, e.g. rounded or triangular, depending on what is the most practical to manufacture.

If for closing insertion opening 61 the rotatable cap 15 is not provided for covering the recesses for appendages 81 and 82, the fuse element can also—as shown in FIG. 12—be provided with a disk-shaped flange 88 whose outer diameter is greater than the maximum diameter determined by appendages 81 and 82. In that case insertion opening 61 is appropriately circular in shape, and encoding is exclusively done by means of metal plate 79 situated below. Insertion opening 61 is closed in every rotational position of fuse element 3.

Figure 13:
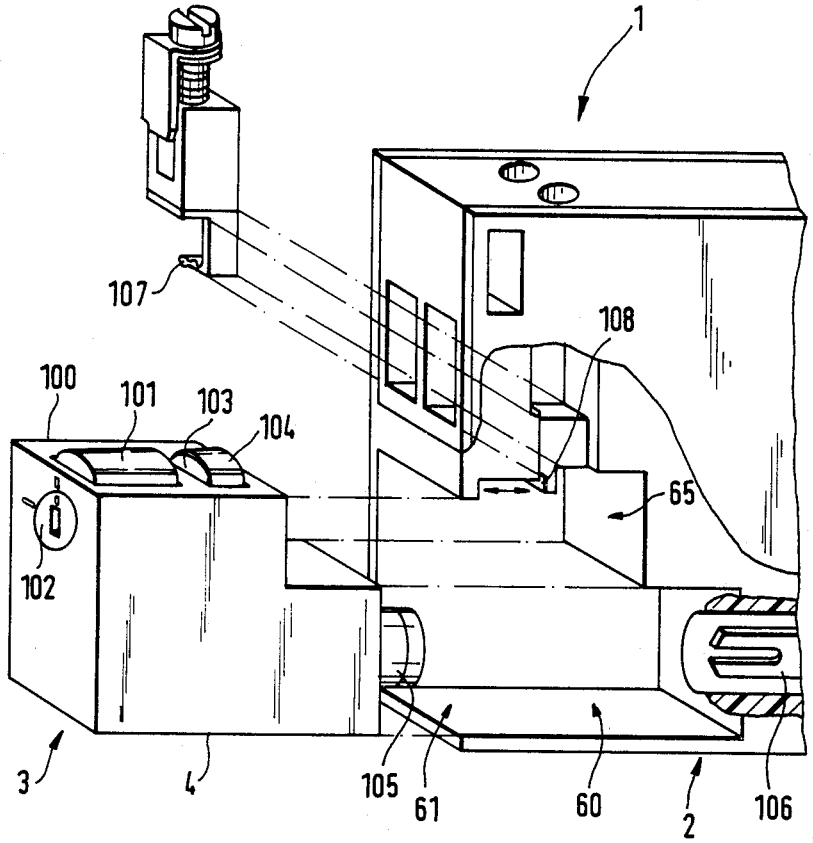
FIG. 13 shows another embodiment of the fuse element according to the invention with an essentially block-shaped casing and a movable appendage, and a movable appendage, and a partly cut-away holder adapted thereto, each seen in perspective.

While in the previously described embodiments the appendage 6/appendages 81 and 82 of the encoding arrangement are rigidly attached to the fuse element, it is possible, as shown in FIG. 13, to design parts of the encoding arrangement with movable attachments. Furthermore the design is not limited to cylindrical casings either, but prismatic shapes are feasible as well.

Fuse element 3 according to FIG. 13 contains a roughly block-shaped casing 4 with a square base; along one side projects a rectangular appendage 100 that matches the width of casing 4 and that is shorter than casing 4. This appendage 100, whose lateral surfaces smoothly merge into the associated lateral surfaces of casing 4, contains a movable appendage 101 which in the simplest case consists of an elongated cylinder flattened on two opposite sides to form a flat-edged body that is rotatably mounted at its longitudinal axis which runs parallel to casing 4.

Appendage 101 is activated by means of a drive 102 that is rotatably mounted in appendage 100 or casing 4 and contains a tool accepting arrangement, for example a slot for a screwdriver. A contact carrier 103 is fixed against relative rotation to appendage 101 and has the same cross-section as appendage 101 which is made from the flat-edged body. This contact carrier 103 carries an electrical contact 104 which is electrically connected to the fuse element arranged in casing 4.

Because the shape of appendage 101 and contact carrier 103 resembles a flattened cylinder, both components protrude in one rotational position above the otherwise level surface of appendage 100 or casing 4, while in another position (turned by 90° in comparison with that shown in FIG. 13), they are almost flush with the surface of the appendage.

The second electrical contact of fuse element 3 is formed by a knife blade contact that is known per se and not shown and that is securely housed in a cylindrical appendage 105. The cylindrical appendage 105 forms an integral part with the end face of casing 4 which lies opposite the end face with drive 102.

As described for the previous embodiments, in this case, too, socket 2 of the electrical apparatus 1 is adapted to the outer contour of fuse element 3 and contains a chamber 60 for casing 4 as well as a subsidiary chamber 65 for appendage 100.

Contacts 106 and 107 that interact with fuse element 3 are on the bottom of chamber 60 and laterally within subsidiary chamber 65, respectively. With fuse element 3 inserted, contact 106 penetrates into the knife blade contact provided in cylindrical appendage 105, while the other contact 107 that is shown enlarged, is situated opposite the opening in appendage 100 in which the rotatable contact carrier 103 is situated.

Beside contact 107 in the same lateral wall of subsidiary chamber 65 is an inwardly opening, rectangular recess 108 which is opposite movable contact 101 when fuse element 3 is inserted.

When the shape of recess 108 is adapted to the longitudinal extent and the radius of movable appendage 101, movable appendage 101 together with movable contact carrier 103 can be turned into the position shown when fuse element 3 is inserted, so that contact 104 can touch contact 107 in the socket, resulting in the connection of both terminals of fuse element 3 to the circuit of electrical apparatus 1. If, however, the dimensions of movable appendage 101 do not match recess 108, for example when movable appendage 101 is larger axially or when it protrudes further from appendage 100 in rotated position than the depth of recess 108, appendage 101 cannot be turned into the position shown, and movable contact carrier 103 cannot connect its contact 104 with the stationary contact 107.

Thus, in this embodiment, encoding can be done either through the shape of the stationary appendage 100, the configuration of movable appendage 101, the position and arrangement of cylindrical appendage 105 and possibly also or additionally through the shape of movable contact carrier 103 which also can assume encoding functions, in all cases in conjunction with the appropriately designed chamber 60 and/or subsidiary chamber 65.

I claim:

1. Encoded fuse arrangement having two electrical contacts (8, 9), particularly for insertion into a socket (2) carrying connection terminals (68, 69), the socket having a coding arrangement which prevents engagement of the contacts of the fuse arrangement with the socket terminals if tripping characteristics of the fuse arrangement are wrong with respect to the characteristics required by the socket, said fuse arrangement having an insulating essentially cylindrical casing (4);

said electrical contacts (8, 9) being accessible from the outside of said casing and protruding on at least one exterior side of the casing, laterally or radially, with respect to a longitudinal axis of the casing;

a fuse element (11) located in the casing (4);

means (16, 17) for electrically connecting the fuse element (11) with the electrical contacts (8, 9);

a fuse element coding arrangement (5) corresponding to the electrical tripping characteristics of the fuse element, wherein the tripping characteristics include at least one of: load carrying capacity or delay time; and wherein the coding arrangement (5) is formed by at least a first appendage (6, 51, 52, 53, 81, 82, 100, 101, 103) secured to and extending laterally or radially in relation to the longitudinal axis of the casing; and at least one of the two electrical contacts (8, 9), is carried by the at least first appendage and protrudes from said appendage laterally or radially with respect to the longitudinal axis of the casing (4), to permit matching of the fuse arrangement of the characteristics required by the socket by the specific shape or location of the at least first appendage.

2. Fuse arrangement according to claim 1, wherein the first appendage (6) extends essentially over the entire length of the casing (4) and contains both contacts (8, 9) which, measured in longitudinal direction of the appendage (6), are situated at a distance from each other.

3. Fuse arrangement according to claim 1, wherein the encoding arrangement (5) contains a second appendage (81, 82) which, like the first appendage, protrudes laterally or radially with respect to the longitudinal axis of the casing (4), the angle between the two appendages being greater than zero degrees, measured in a plane perpendicular to the longitudinal axis of the casing (4), and wherein the angle between the two appendages (81, 82) represents at least one of the tripping characteristics of the fuse arrangement.

4. Fuse arrangement according to claim 1, wherein the first appendage includes first and second appendage sections (*6a, 6b,* 81, 82) which together define a gap or recess (7) between themselves and at least one of the electrical tripping characteristics of the fuse arrangement is encoded in at least one of: the axial position, configuration, depth or length of said gap (7).

5. Fuse arrangement according to claim 1, wherein the casing comprises a base structure (4, 13) and a carrier (15) rotatably mounted with respect to said longitudinal axis;

a second appendage (51, 52, 53, 85, 86), forming part of the coding arrangement, being formed on the rotatable carrier; and wherein at least one electrical tripping characteristic of the fuse element is encoded in the configuration of said second appendage.

6. Fuse arrangement according to claim 5, wherein the tripping characteristics of the fuse arrangement (11) are encoded in an angle at the circumference of the second appendage measured in a plane perpendicular to the longitudinal axis of the casing (4), and wherein the second appendage has constant radial dimensions at its circumference over this angle.

7. Fuse arrangement according to claim 5, wherein the base structure defines an end face; and the carrier is located at the end face of the base structure of the casing.

8. Fuse arrangement according to claim 5, wherein the rotatable carrier (15) defines an end face;

wherein, in the longitudinal direction with respect to the base structure of the casing, an additional appendage (52) is formed on the rotatable carrier, located between the second appendage (53) and the end face of the carrier remote from the base structure, said additional appendage (52) covering and overlapping said second appendage (53); and wherein the additional appendage (52) has a dimension which overlaps and extends over the second appendage to at least cover the maximum circumferential extent of said second appendage.

9. Fuse arrangement according to claim 5, wherein the first appendage formed on the casing comprises first and second appendage sections (81, 82), said appendage sections extending in the longitudinal direction with respect to the casing, and carrying, respectively, said electrical contacts (8, 9);

and wherein the carrier (15) is formed with a level end face fitting against an end of the casing, and the second appendage on the carrier has a projection, in the axial direction, which is at least as large as the projection of said appendage sections including the electrical contacts; and wherein said second appendage from the carrier is free of said electrical contacts (8, 9).

10. Fuse arrangement according to claim 5, wherein the angle of rotation of the carrier (15) with respect to the base structure is limited.

11. Fuse arrangement according to claim 1, wherein said fuse element comprises a commercially available tubular fuse (11) having metallic ends caps (19); the electrically connecting means (16, 17) comprise contact vanes coupled to said metallic end caps;

at least one of said vanes protruding outwardly through at least the first appendage (6a, 6b) and forming one of the electrical contacts (8, 9).

12. Fuse arrangement according to claim 11, including a spacer (23) located between said contact vanes (16, 17), said spacer (23) extending between the contacts (8, 9) into the first appendage (6) and defining a recess (26) having a predetermined dimension or configuration, and wherein at least one tripping characteristic of the fuse arrangement (3) is encoded in the dimension or configuration of said recess.

13. Fuse arrangement according to claim 12, wherein said spacer (23) is located inside the casing (4) and fits on the fuse element (11).

14. In a coded fusing system having a coding arrangement particularly for a fuse arrangement having a coding arrangement including a first appendage as claimed in claim 1, a socket (2) comprising a housing structure, said housing structure being formed with a chamber (60, 65) and an insertion opening (61) at an end face of the housing structure, for longitudinal insertion of the fuse arrangement (3) into the housing structure and for placement, at least in part, in said chamber, said socket comprising at least two contact terminals (68, 69) located on the socket and protruding into the chamber for engagement by the electrical contacts (8, 9) of the fuse arrangement;

wherein the insertion opening (60) for the fuse arrangement (3) is adapted to the encoding arrangement of the fuse arrangement and forms at least part of the coding arrangement of the system by means of a recess which conforms to the shape of the first appendage of the fuse arrangement whereby only a fuse arrangement (3) having a first appendage of a specific size and shape at a specific location may be inserted into the socket.

15. The socket of claim 14, including a rim adjacent the insertion opening (61) extending in the longitudinal axis of chamber (60) and forming at least part of the coding arrangement.

16. The socket of claim 15, wherein the rim of the insertion opening (61) has a shape and configuration adapted to the outer contour of an end face of the fuse arrangement (3).

17. The socket of claim 14, wherein at least one of the socket terminals (68, 69, 107) is located to be positioned adjacent the fuse arrangement (3) when the fuse arrangement is positioned in said chamber;

and wherein the location and configuration of said socket terminal (68, 69) is matched to and fitted to the operating or energized position of the fuse arrangement (3).

18. The socket of claim 14, wherein both socket terminals (68, 69) are located laterally with respect to said insertion opening (61) and are matched to and fitted to the electrical terminals (8, 9) of the fuse arrangement (3) when the fuse arrangement is in an energized position and located in the socket.

19. The socket of claim 14, wherein said chamber (60, 65) is divided into two chamber portions, one of said chamber portions being shaped for rotatable reception of said fuse arrangement (3) over a limited angle of rotation.

20. The socket of claim 14, further comprising a stop element (72) protruding into the chamber (60, 65), said stop element being dimensioned and shaped to provide for coding of a tripping characteristic of said system;

and wherein the fuse arrangement comprises a multi-section appendage (6), which, when located within the socket, is positioned in said chamber (60, 65), said stop arrangement permitting movement of said fuse arrangement for engagement of the electrical contacts (8, 9) with the socket terminals (68, 69) only if the tripping characteristics of the fuse arrangement match the tripping characteristics of the socket.

21. The socket of claim 20, wherein said stop (72) is irremovably placed in the housing structure to prevent tampering with the tripping characteristics of the coding of the socket.

22. The socket of claim 14, wherein the insertion opening (61) is formed with recesses (62, 63, 83, 84) adapted to match at least one appendage (6, 51, 52, 81, 82, 85, 86, 100) protruding from the casing (4) of the fuse arrangement, and said recesses are open in a direction parallel to a longitudinal axis of the chamber and in the direction of the longitudinal axis of the fuse arrangement.

23. The socket of claim 14, further including an insertable coding plate (79)

means (62) formed adjacent said insertion opening for receiving the insertable coding plate, said insertable coding plate being formed with at least one recess (80) aligned flush with a socket recess (63) formed at the outer edge of the insertion opening (61), said recess 80 in the coding plate forming part of the tripping characteristic coding of the socket, the socket recess (63) of the insertion opening extending over all possible positions of the coding plate recess (80) to permit universal use of the housing structure of the socket and provide for coding by an inserted said coding plate;

and wherein a fuse arrangement positioned in said socket is flush with an outer end face of the socket housing structure adjacent said insertion opening.

24. The socket of claim 14, wherein said socket is part of a safety device containing electronic components (1).

25. Encoded fuse arrangement having two electrical contacts (8, 9), particularly for insertion into a socket (2) carrying connection terminals (68, 69) the socket having a coding arrangement which prevents engagement of the contacts of the fuse arrangement with the socket terminals if tripping characteristics required by the socket, said fuse arrangement having an insulating essentially cylindrical casing (4);

said electrical contacts (8, 9) being accessible from the outside of said casing and protruding on at least one exterior side of the casing laterally or radially with respect to a longitudinal axis of the casing;

a fuse element (11) located in the casing (4);

means (16, 17) for electrically connecting the fuse element (11) with the electrical contacts (8, 9);

a fuse element coding arrangement (5) corresponding to the electrical tripping characteristics of the fuse element, wherein the tripping characteristics include at least one of: load carrying capacity or delay time;

at least one first appendage (6, 51, 52, 53, 81, 82) protruding from said casing laterally or radially with respect to the longitudinal axis of the casing (4);

wherein said casing comprises a base structure (4, 13) and a carrier (15) rotatably mounted with respect to said longitudinal axis;

a second appendage (51, 52, 53, 85, 86) forming part of the coding arrangement, being formed on the rotatable carrier; and wherein at least one electrical tripping characteristic of the fuse arrangement is encoded in the configuration of said second appendage, to permit matching of the fuse arrangement to the characteristics required by the socket by the specific shape or location of the at least first appendage.

26. Fuse arrangement according to claim 25, wherein the angle of rotation of the carrier (15) with respect to the base structure is limited.

27. Fuse arrangement according to claim 25, wherein the tripping characteristics of the fuse arrangement (11) are encoded in an angle at the circumference of the second appendage measured in a plane perpendicular to the longitudinal axis of the casing (4), and wherein the second appendage has constant radial dimensions at its circumference over this angle.

28. Fuse arrangement according to claim 25, wherein the base structure defines an end face; and the carrier (15) is located at the end face of the base structure of the casing.

29. Fuse arrangement according to claim 25, wherein the rotatable carrier (15) defines an end face;

wherein, in the longitudinal direction with respect to the base structure of the casing, an additional appendage (52) is formed on the rotatable carrier, located between the second appendage (53) and the end face of the carrier remote from the base structure, said additional appendage (52) covering and overlapping said second appendage (53); and wherein the additional appendage (52) has a dimension which overlaps and extends over the second appendage to at least cover the maximum circumferential extent of said second appendage.

30. Fuse arrangement according to claim 25, wherein the first appendage formed on the casing comprises first and second appendage sections (81, 82), said appendage sections extending in the longitudinal direction with respect to the casing, and carrying, respectively, said electrical contacts (8, 9);

and wherein the carrier (15) is formed with a level end face fitting against an end of the casing, and the second appendage on the carrier has a projection, in the axial direction, which is at least as large as the projection of said appendage sections including the electrical contacts; and wherein said second appendage from the carrier is free of said electrical contacts (8, 9).

31. Fuse arrangement according to claim 27, wherein said fuse element comprises a commercially available tubular fuse (11) having metallic end caps (19); the electrically connecting means (16, 17) comprise contact vanes coupled to said metallic end caps;

at least one of said vanes protruding outwardly through at least the first appendage (*6a, 6b*) and forming one of the electrical contacts (8, 9).

32. Fuse arrangement according to claim 31, including a spacer (23) located between said contact vanes (16, 17), said spacer (23) extending between the contacts (8, 9) into the first appendage (6) and defining a recess (26) having a predetermined dimension or configuration, and wherein at least one tripping characteristic of the fuse arrangement (3) is encoded in the dimension or configuration of said recess.

33. Fuse arrangement according to claim 32, wherein said spacer (23) is located inside the casing (4) and fits on the fuse element (11).

34. In a coded fusing system having a coding arrangement particularly for a fuse arrangement having a coding arrangement including a first appendage as claimed in claim 25, a socket (2) comprising a housing structure, said housing structure being formed with a chamber (60, 65) and an insertion opening (61) at an end face of the housing structure, for longitudinal insertion of the fuse arrangement (3) into the housing structure and for placement, at least in part, in said chamber, said socket comprising at least two contact terminals (68, 69) located on the socket and protruding into the chamber for engagement by the electrical contacts (8, 9) of the fuse arrangement;

wherein the insertion opening (61) for the fuse arrangement (3) is adapted to the encoding arrangement of the fuse arrangement and forms at least part of the coding arrangement of the system by means of a recess which conforms to the shape of the first appendage of the fuse arrangement whereby only a fuse arrangement (3) having the first appendage of a specific size and shape at a specific location may be inserted into the socket.

35. The socket of claim 34, including a rim adjacent the insertion opening (61) extending in the longitudinal axis of chamber (60) and forming at least part of the coding arrangement.

36. The socket of claim 35, wherein the rim of the insertion opening (61) has a shape and configuration adapted to the outer contour of an end face of the fuse arrangement (3).

37. The socket of claim 34, wherein at least one of the socket terminals (68, 69, 107) is located to be positioned adjacent the fuse arrangement (3) when the fuse arrangement is positioned in said chamber;

and wherein the location and configuration of said socket terminal (68, 69) is matched to and fitted to the operating or energized position of the fuse arrangement (3).

38. The socket of claim 34, wherein both socket terminals (68, 69) are located laterally with respect to said insertion opening (61) and are matched to and fitted to the electrical terminals (8, 9) of the fuse arrangement (3) when the fuse arrangement is in an energized position and located in the socket.

39. The socket of claim 34, wherein said chamber (60, 65) is divided into two chamber portions, one of said chamber portions being shaped for rotatable reception of said fuse arrangement (3) over a limited angle of rotation.

40. The socket of claim 34, further comprising a stop element (72) protruding into the chamber (60, 65), said stop element being dimensioned and shaped to provide for coding of a tripping characteristic of said system;

and wherein the fuse arrangement comprises a multi-section appendage (6), which, when located within the socket, is positioned in said chamber (60), said stop arrangement permitting movement of said fuse arrangement for engagement of the electrical contacts (8, 9) with the socket terminals (68, 69) only if the tripping characteristics of the fuse arrangement match the tripping characteristics of the socket.

41. The socket of claim 40, wherein said stop (72) is irremovably placed in the housing structure to prevent tampering with the tripping characteristics of the coding of the socket.

42. The socket of claim 34, wherein the insertion opening (61) is formed with recesses (62, 63, 83, 84) adapted to match at least one appendage (6, 51, 52, 81, 82, 85, 86, 100) protruding from the casing (4) of the fuse arrangement, and said recesses are open in a direction parallel to a longitudinal axis of the chamber and in the direction of the longitudinal axis of the fuse arrangement.

43. The socket of claim 34, further including an insertable coding plate (79);

means (62) formed adjacent said insertion opening for receiving the insertable coding plate, said insertable coding plate being formed with at least one recess (80) aligned flush with a recess (63) formed at the outer edge of the insertion opening (61), said recess (80) in the coding plate forming part of the tripping characteristic coding of the socket, the recess (63) of the insertion opening extending over all possible positions of the coding plate recess (80) to permit universal use of the housing structure of the socket and provide for coding by an inserted coding plate;

and wherein a fuse arrangement position in said socket is flush with an outer end face of the socket housing structure adjacent said insertion opening.

44. The socket of claim 34, wherein said socket is part of a safety device containing electronic components (1).

45. A tamper-resistant tripping coded fuse holder arrangement comprising an essentially cylindrical casing (4) formed with an essentially cylindrical opening therein;

two openings formed laterally in said casing;

two electrical contacts (8, 9) accessible from outside of said casing and protruding through respective ones of said lateral openings;

a bottom (13) formed on said casing;

said cylindrical opening being adapted to receive a commercially available tubular fuse (11) having metallic end caps (19), said electrical contacts comprising contact vanes (16, 17) protruding outwardly through said lateral openings and coupled to said end caps;

and tamper-resistant closing means closing off said essentially cylindrical opening comprising an undercut bead (33) formed on the casing (4) and defining a groove between the bead and an upper portion of the casing;

and a closing cap (15) having a projecting rim fitting about said undercut bead, said projecting rim being formed with inwardly extending claws or barbs (36, 37, 38) resiliently deflectable outwardly, for resilient deflection ground said bead and engagement in said groove.

46. The fuse arrangement of claim 45, wherein said casing and said cap comprise plastic material;

and wherein the casing includes a fuse coding arrangement (5) corresponding to the electrical tripping characteristics of the fuse (11), wherein the tripping characteristics include at least one of: load carrying capacity or delay time;

a first appendage (6, 51, 52, 53, 81, 82, 100, 101, 103) extending from said casing laterally or radially with respect to the longitudinal axis of the casing;

a second appendage (51, 52, 53, 85, 86) formed on said closing cap (15); and wherein at least one electrical tripping characteristic of the fuse is encoded in the configuration of at least one of said appendages.

47. The fuse arrangement of claim 45 including a spacer (23) located between said contact vanes (16, 17), said spacer (23) extending between the contacts (8, 9) into the first appendage (6) and defining a recess (26) having a predetermined dimension or configuration, and wherein at least one tripping characteristic of the fuse arrangement (3) is encoded in the dimension or configuration of said recess.

* * * * *